US009002218B2

(12) United States Patent
Yamaguchi

(10) Patent No.: US 9,002,218 B2
(45) Date of Patent: Apr. 7, 2015

(54) DEVELOPING DEVICE AND IMAGE FORMING APPARATUS

(71) Applicant: Fuji Xerox Co., Ltd., Tokyo (JP)

(72) Inventor: Yoshinori Yamaguchi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 120 days.

(21) Appl. No.: 13/623,508

(22) Filed: Sep. 20, 2012

(65) Prior Publication Data

US 2013/0156446 A1 Jun. 20, 2013

(30) Foreign Application Priority Data

Dec. 16, 2011 (JP) ..... 2011-275203

(51) Int. Cl.
*G03G 15/08* (2006.01)

(52) U.S. Cl.
CPC ..... *G03G 15/0812* (2013.01); *G03G 15/0831* (2013.01); *G03G 15/08* (2013.01)

(58) Field of Classification Search
CPC ..... G03G 15/0812; G03G 15/0831
USPC ..... 399/27, 61, 274, 284
See application file for complete search history.

(56) References Cited

U.S. PATENT DOCUMENTS

| | | | | |
|---|---|---|---|---|
| 5,493,370 | A * | 2/1996 | Brewington et al. | 399/284 |
| 5,587,770 | A * | 12/1996 | Jo et al. | 399/27 |
| 2005/0185990 | A1 * | 8/2005 | Ahn | 399/258 |
| 2006/0002722 | A1 * | 1/2006 | Murata | 399/27 |

FOREIGN PATENT DOCUMENTS

JP A-2008-076428 4/2008

* cited by examiner

*Primary Examiner* — David Gray
*Assistant Examiner* — Thomas Giampaolo, II
(74) *Attorney, Agent, or Firm* — Oliff PLC

(57) ABSTRACT

Provided is a developing device including a container that contains developer; a developing roller that transports the developer within the container to a photoconductor side; a trimmer having a tip brought close to the developing roller, and provided upstream of the photoconductor in a transporting direction by the developing roller; and a detector provided in the trimmer or in the vicinity of the trimmer of the inner surface of the container to detect the pressure caused by the developer.

6 Claims, 10 Drawing Sheets

FIG. 4

○ · · NORMAL PRESSURE
△ · · PRESSURE DROP

| PRESSURE SENSOR OUTPUT OF A | PRESSURE SENSOR OUTPUT OF B | PRESSURE SENSOR OUTPUT OF C | POOR IMAGE CONTENTS | TREATMENT DISPLAY CONTENTS |
|---|---|---|---|---|
| ○ | ○ | ○ | NORMAL | PRINTING CONTINUATION |
| ○ | ○ | △ | IMAGE DENSITY DECLINE, UNEVEN DENSITY | TONER REPLENISHMENT |
| ○ | △ | ○ | IMAGE DENSITY DECLINE, UNEVEN DENSITY | TONER REPLENISHMENT |
| ○ | △ | △ | IMAGE DENSITY DECLINE, UNEVEN DENSITY | TONER REPLENISHMENT |
| △ | ○ | ○ | IMAGE DENSITY DECLINE, UNEVEN DENSITY | TONER REPLENISHMENT |
| △ | ○ | △ | IMAGE DENSITY DECLINE, UNEVEN DENSITY | TONER REPLENISHMENT |
| △ | △ | ○ | IMAGE DENSITY DECLINE, UNEVEN DENSITY | TONER REPLENISHMENT |
| △ | △ | △ | IMAGE DENSITY DECLINE | TONER REPLENISHMENT |

FIG. 5

○ · · NORMAL PRESSURE
× · · PRESSURE RISE

| PRESSURE SENSOR OUTPUT OF A | PRESSURE SENSOR OUTPUT OF B | PRESSURE SENSOR OUTPUT OF C | POOR IMAGE CONTENTS | TREATMENT DISPLAY CONTENTS |
|---|---|---|---|---|
| ○ | ○ | ○ | NORMAL | PRINTING CONTINUATION |
| ○ | ○ | × | GRAINNESS DEGRADATION, UNEVEN DENSITY | FORCED TONER DISCHARGE |
| ○ | × | ○ | GRAINNESS DEGRADATION, UNEVEN DENSITY | FORCED TONER DISCHARGE |
| ○ | × | × | GRAINNESS DEGRADATION, UNEVEN DENSITY | FORCED TONER DISCHARGE |
| × | ○ | ○ | GRAINNESS DEGRADATION, UNEVEN DENSITY | FORCED TONER DISCHARGE |
| × | ○ | × | GRAINNESS DEGRADATION, UNEVEN DENSITY | FORCED TONER DISCHARGE |
| × | × | ○ | GRAINNESS DEGRADATION, UNEVEN DENSITY | FORCED TONER DISCHARGE |
| × | × | × | GRAINNESS DEGRADATION | FORCED TONER DISCHARGE |

FIG. 6

| DETERMINATION CONTENTS OF ARITHMATIC UNIT | | | | TREATMENT DISPLAY CONTENTS |
|---|---|---|---|---|
| PRESSURE SENSOR (CENTRAL) OUTPUT | PRESSURE SENSOR (END) OUTPUT | AUXILIARY SENSING (TC SENSOR*OUTPUT) | SYMPTOMS | |
| NORMAL | LARGER THAN SPECIFIED VALUE | NO REFER | DEVELOPER DETERIORATION | · TONER REPLACEMENT<br>· DEVELOPER REPLACEMENT |
| NORMAL | SMALLER THAN SPECIFIED VALUE | NORMAL | MAGNET ROLL SEAL DEFECT | SEAL REPLACEMENT |
| | | ABNORMAL (TONER AMOUNT DECREASE) | TONER SHORTAGE | TONER REPLENISHMENT |
| LARGER THAN SPECIFIED VALUE | LARGER THAN SPECIFIED VALUE | NO REFER | DEVELOPER DETERIORATION | · TONER REPLACEMENT<br>· DEVELOPER REPLACEMENT |

(CONT.)

(FIG. 6 Continued)

| | | | | |
|---|---|---|---|---|
| LARGER THAN SPECIFIED VALUE | SMALLER THAN SPECIFIED VALUE | NORMAL | · DEVELOPER DETERIORATION<br>· MAGNET ROLL SEAL DEFECT | · TONER REPLACEMENT<br>· DEVELOPER REPLACEMENT<br>· SEAL REPLACEMENT |
| | | ABNORMAL (TONER AMOUNT DECREASE) | · DEVELOPER DETERIORATION<br>· TONER SHORTAGE | · TONER REPLACEMENT<br>· DEVELOPER REPLACEMENT |
| LARGER THAN SPECIFIED VALUE | NORMAL | NO REFER | DEVELOPER DETERIORATION | · TONER REPLACEMENT<br>· DEVELOPER REPLACEMENT |
| SMALLER THAN SPECIFIED VALUE | LARGER THAN SPECIFIED VALUE | ABNORMAL (TONER AMOUNT DECREASE) | · TONER SHORTAGE<br>· DEVELOPER DETERIORATION | · TONER REPLACEMENT<br>· DEVELOPER REPLACEMENT |
| SMALLER THAN SPECIFIED VALUE | SMALLER THAN SPECIFIED VALUE | ABNORMAL (TONER AMOUNT DECREASE) | · TONER SHORTAGE<br>· MAGNET ROLL SEAL DEFECT | · TONER REPLENISHMENT<br>· SEAL REPLACEMENT |
| SMALLER THAN SPECIFIED VALUE | NORMAL | ABNORMAL (TONER AMOUNT DECREASE) | TONER SHORTAGE | TONER REPLENISHMENT |

DEVELOPING DEVICE AND IMAGE FORMING APPARATUS

CROSS-REFERENCE TO RELATED APPLICATIONS

This application is based on and claims priority under 35 USC 119 from Japanese Patent Application No. 2011-275203 filed Dec. 16, 2011.

BACKGROUND (i) Technical Field

The present invention relates to a developing device and an image forming apparatus that have a function to detect the state of developer.

(ii) Related Art

Image forming apparatuses are, for example, apparatuses, which form an image on a recording medium, such as paper, with toner, such as a copying machine, a facsimile machine, a printer apparatus, and a composite device having these functions together.

In such image forming apparatuses, a developer obtained by mixing a carrier, a charging accelerator, and the like in the toner is used. In a developing device provided in the image forming apparatuses, the toner is made to adhere to a developing roller from the developer contained in the container, the toner is carried onto a photoconductor by the rotation of the developing roller, and an electrostatic latent image formed on the photoconductor is developed with toner.

In such a developing device, it is known that, if deterioration, shortage, or the like of the toner occurs, the flowability of the developer may decline, and thus, a development defect may be caused.

SUMMARY

According to an aspect of the invention, there is provided a developing device including a container that contains developer; a developing roller that transports the developer within the container to a photoconductor side; a trimmer having a tip brought close to the developing roller, and provided upstream of the photoconductor in a transporting direction by the developing roller; and a detector provided in the trimmer or in the vicinity of the trimmer of the inner surface of the container to detect the pressure caused by the developer.

BRIEF DESCRIPTION OF THE DRAWINGS

Exemplary embodiments of the present invention will be described in detail based on the following figures, wherein:

FIG. 4 is a table illustrating relationship between detected pressure, a developer state, and a treatment method related to an exemplary embodiment of the invention;

FIG. 5 is a table illustrating relationship between the detected pressure, the developer state, and the treatment method related to an exemplary embodiment of the invention;

FIG. 6 is a table illustrating relationship between the detected pressure, the developer state, and the treatment method related to an exemplary embodiment of the invention;

DETAILED DESCRIPTION

First, an example of an image forming apparatus that carries out an exemplary embodiment of the invention will be described.

Figure 8:
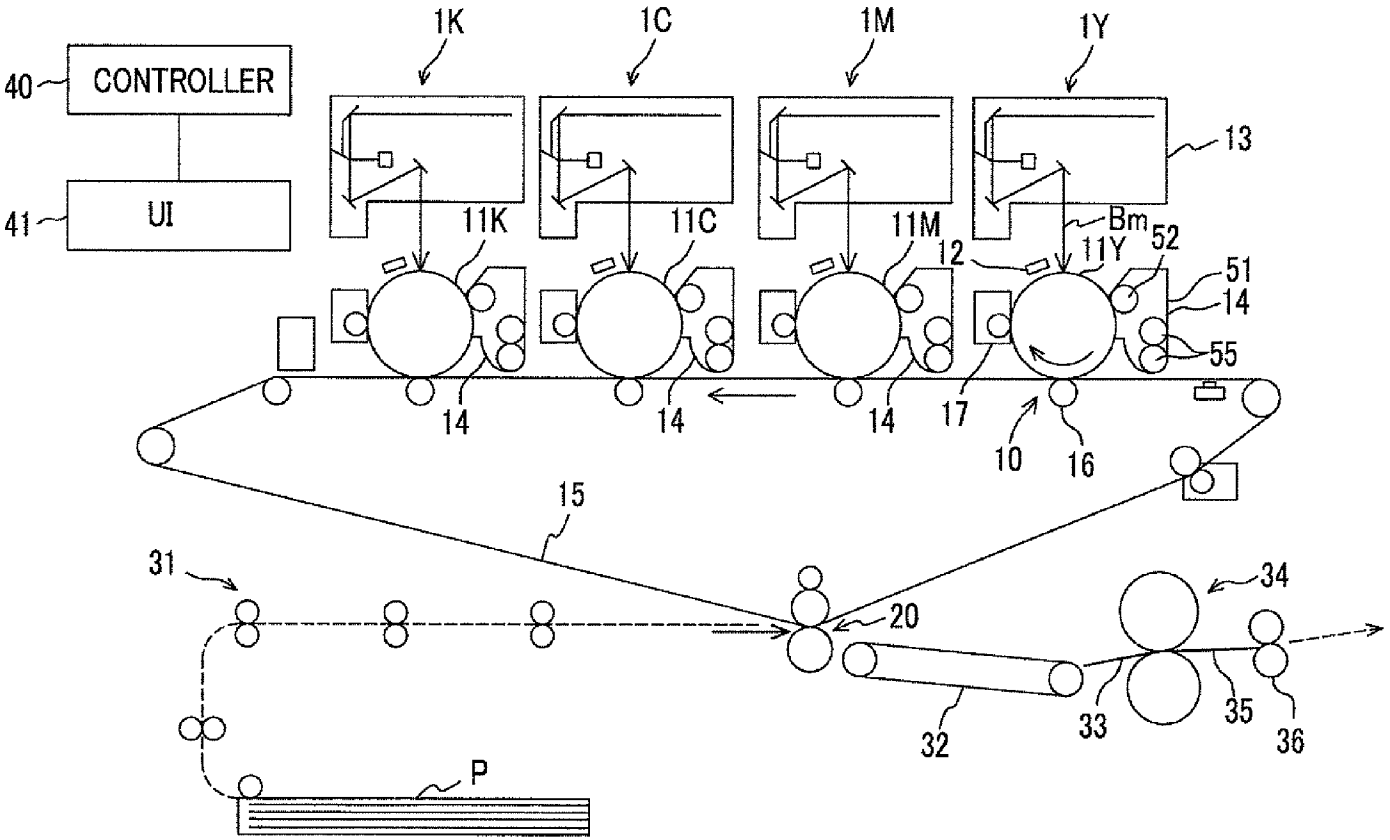
FIG. 8 is a configuration view of an image forming section of the image forming apparatus related to an exemplary embodiment of the invention.

In FIG. 8, the structure of an image forming section in the image forming apparatus of this example is illustrated.

The illustrated image forming apparatus is generally an intermediate transfer type called a tandem type, and includes, as typical functional sections, plural image forming units 1Y, 1M, 1C, and 1K in which toner images of respective color components are formed using an electrophotographic method, a primary transfer section 10 that sequentially transfers (primarily transfers) the respective color component toner images formed by the respective image forming units 1Y, 1M, 1C, and 1K to an intermediate transfer belt 15, a secondary transfer section 20 that collectively transfers (secondarily transfers) a superposed toner image transferred onto the intermediate transfer belt 15 to paper P (an example of a recording medium), and a fixing device 34 that fixes the image secondarily transferred onto the paper P.

Additionally, an image forming apparatus of this example includes a controller 40 that controls the operation of the respective sections, and a user interface (UI) 41 for presenting information to a user or receiving an instruction from the user.

Each of the image forming units 1Y, 1M, 1C, and 1K has a photoconductor drum 11 (11Y, 11M, 11C, 11K) that rotates in the direction of an arrow in the drawing. Additionally, various kinds of electrophotographic devices, including a charger 12 that charges the photoconductor drum 11, an exposure unit 13 that irradiates the photoconductor drum 11 with an exposure beam Bm to write an electrostatic latent image on the drum, a developing unit 14 that contains each color component toner, and makes the electrostatic latent image on the photoconductor drum 11 into a visualized toner image, a primary transfer roll 16 that transfers the toner image of each color component formed on the photoconductor drum 11 onto the intermediate transfer belt 15 in a superposed manner in the primary transfer section 10, and a drum cleaner 17 (17Y, 17M, 17C, 17K) that removes the residual toner on the photoconductor drum 11, are sequentially disposed around each photoconductor drum 11.

The image forming units 1Y, 1M, 1C, and 1K are arranged in the shape of a substantially straight line in order of yellow (Y), magenta (M), cyan (C), and black (K) from the upstream side of the intermediate transfer belt 15, and is configured so as to be able to come into contact with or separate from the intermediate transfer belt 15.

Additionally, the illustrated image forming apparatus, includes, as a paper transporting system, a paper feed mechanism section 31 that performs the paper feed operation of taking out paper P from a paper accommodating section and feeding the paper into the secondary transfer section 20, a transporting belt 32 that transports the paper P, which has passed through the secondary transfer section 20, to the fixing device 34 side, a fixing inlet guide 33 that guides the paper P to an inlet of the fixing device 34, a paper discharge guide 35 that guides the paper P discharged from the fixing device 34, and a paper discharge roll 36 that discharges the paper P guided by the paper discharge guide 35 to the outside of the apparatus.

That is, the paper P fed from the paper accommodating section to the secondary transfer section 20 by the paper feed mechanism section 31 is transported to the transporting belt 32 in a state where the paper is peeled from the intermediate transfer belt 15 after the toner images on the intermediate transfer belt 15 are electrostatically transferred in the secondary transfer section 20. Then, the paper is transported to the fixing device 34 via the fixing inlet guide 33 in conformity with the operating speed of the fixing device 34 by the transporting belt 32. An unfixed toner image on the paper P conveyed to the fixing device 34 is fixed on the paper P by receiving the fixing processing of applying heat and pressure using the fixing device 34. Thereafter, the paper P on which the fixed image has been formed is transported to a discharged paper accommodating section (not shown) provided outside the apparatus, via the paper discharge guide 35 and the paper discharge roll 36.

Figure 1A:
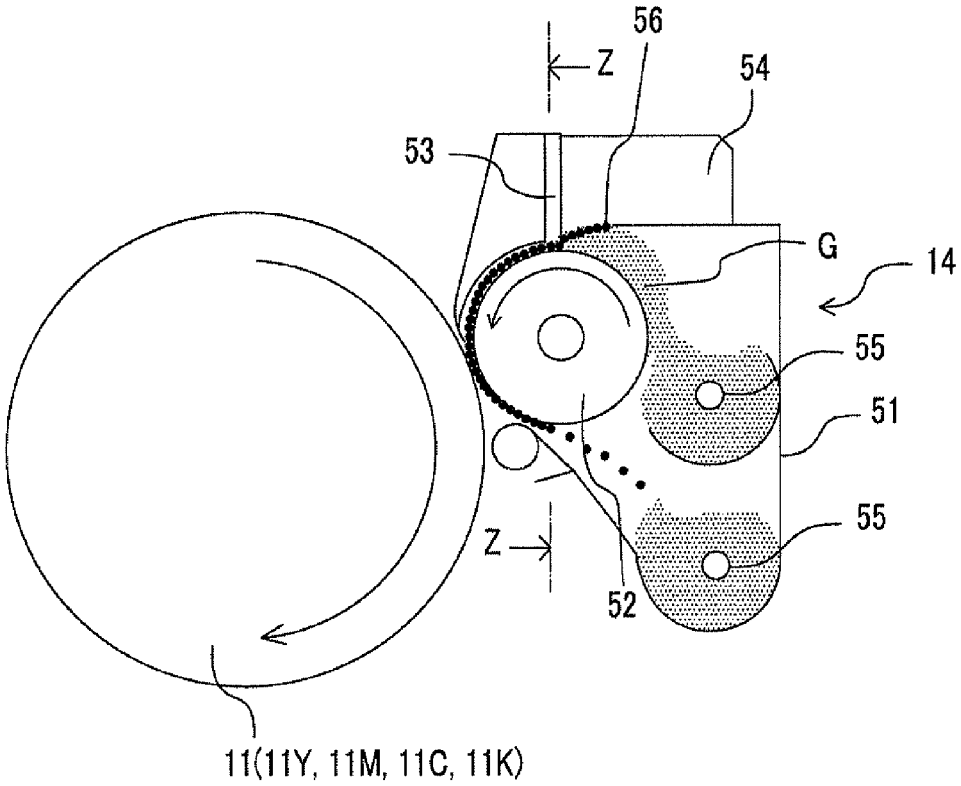
FIGS. 1A and 1B are configuration views of a developing device related to an exemplary embodiment of the invention.
Figure 1B:
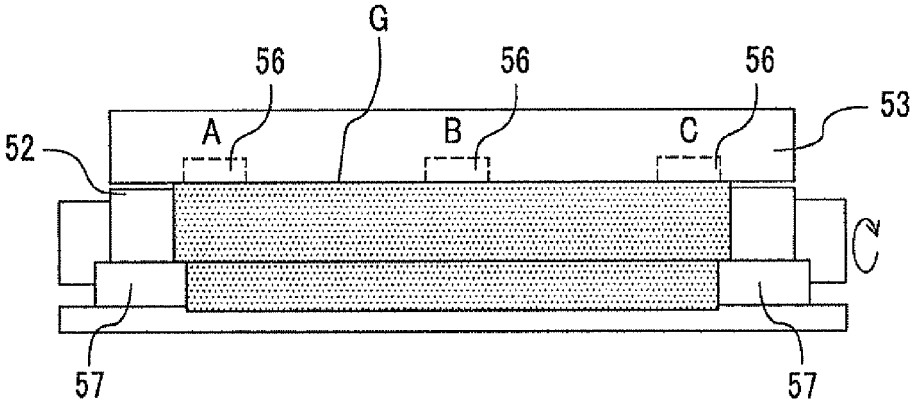

FIGS. 1A and 1B show the configuration of the developing unit 14, FIG. 1A shows a state where the developing unit 14 is seen from the side, and FIG. 1B shows a state where the developing unit 14 is seen in a Z-Z section.

In addition, the developing devices 14 for the respective color components have the same structure.

The developing unit 14 has a container 51 that contains developer G, a developing roller 52 that transports the developer G within the container 51 to the photoconductor 11 side, a plate-shaped trimmer 53 that is provided such that the tip thereof is brought close to the developing roller 52, a trimmer block 54 that fixes and supports the trimmer 53 and is attached to an upper part of the container 51, an auger 55 that is rotationally driven within the container 51 to stir and mix the developer G within the container 51 and transport the developer to the developing roller 52 side, and pressure sensors 56 that are provided in the vicinity of the upstream of the trimmer 53 in the inner surface of the container 51.

The developing roller 52 is rotationally driven around an axis as indicated by an arrow in FIGS. 1A and 1B, makes the developer G sent by the auger 55 adhere to the peripheral surface thereof, and transports the developer to the photoconductor 11 side.

In this example, although a mug roll that holds the developer G on the peripheral surface thereof with a magnetic force is used as the developing roller 52, there is no particular limitation on the type of the developing roller.

The toner of the developer G transported by the developing roller 52 is adsorbed on the photoconductor 11 with a magnetic force and develops the electrostatic latent image of the photoconductor 11. Then, the residual developer G of which the toner has been adsorbed on the photoconductor 11 is recovered into the container 51 by the rotation of the developing roller 52.

In addition, reference numeral 57 in FIG. 1B designates a seal, which seals both ends of the developing roller 52 to prevent the developer G from leaking from the ends of the developing roller 52 to the outside. The seal 57 is outside the developer adhesion range at both ends of the developing roller 52, and is a portion without a magnetic force in the mug roll 52.

The trimmer 53 has a rectangle plate shape that is long along the width direction of the developing roller 52, and is provided upstream of the photoconductor 11 in the transporting direction of the developer G by the developing roller 52.

The trimmer 53 levels the developer G adhering to the peripheral surface of the developing roller 52, thereby uniformizing the amount or surface texture of the developer to be transported to the photoconductor 11 side by the developing roller 52.

In addition, in the present exemplary embodiment, the trimmer 53 is attached to the container 51 by the trimmer block 54. However, a method of attaching the trimmer, such as attaching the trimmer 53 without using the trimmer block 54 or the like, may be appropriately determined in consideration of the relationship with other constituent portions or the like.

The auger 55 is a shaft in which a flange portion is spirally formed on a peripheral surface, and a developer feed part that is rotationally driven within the container 51 to thereby stir and mix the developer G within the container 51 and transport the developer to the developing roller 52 side. That is, in the present exemplary embodiment, the developer G within the container 51 is forced to flow by the feed part.

In addition, various feed parts may be adopted in addition to the auger.

Since the pressure sensors 56 are provided in the vicinity of the upstream of the trimmer 53 in the inner surface of the container 51, the developer G flowing in the container 51 faces a region throttled by the trimmer 53, and detects the pressure that the flowing developer G undergoes in this throttled region.

Accordingly, it is possible to detect the pressure that the developer G undergoes, over the total amount of the developer G that flows by the developing roller 52 or the auger 55.

Here, in the present exemplary embodiment, as shown in FIG. 1B, pressure sensors 56 are provided at positions corresponding to three places at both ends A and C and a central portion B of the trimmer 53, and the pressures of the three places at the region where the developer G is throttled by the trimmer 53 are detected by the three pressure sensors 56, respectively.

In addition, since the pressure sensors 56 face the region where the developer G to be transported is throttled by the trimmer 53, for example, as shown in FIG. 1B, in a case where the trimmer 53 with a length that also covers both ends of the mug roll in which portions that do not have a magnetic force are provided at both ends, it should be understood that both ends of the trimmer mean both ends within a range related a developer throttle of the trimmer (that is, a range where the developer G is made to adhere and is transported in an axial direction of the developing roller 52).

Accordingly, the pressure undergone by developer G which flows within the container 51 may be detected in a wide large range along the width direction of the developing roller 52 by arranging the three pressure sensors 56 as mentioned above.

Also, as will be described below, in the present exemplary embodiment, the treatment method concerning the state of the developer or toner may be determined depending on the combination of the pressures detected by the pressure sensors 56.

In addition, although the example in which three pressure sensors 56 are arranged as mentioned above has been described in the present exemplary embodiment, even if one pressure sensor corresponding to an arbitrary position within a range related to the developer throttle of the trimmer is provided, the pressure that the developer flows as mentioned above undergoes may be detected. Additionally, the number and arrangement position of the pressure sensors 56 may be appropriately set if needed, such as providing two pressure sensors at both ends within a range related to the developer throttle.

Additionally, arbitrary methods may be adopted if an aspect in which the pressure sensors 56 face a region where the developer G is throttled by the trimmer 53 is provided, for example, such that the pressure sensors are directly attached to the inner wall of the container 51, such that the trimmer block 54 is provided to face the inner surface of the container 51, and the pressure sensors are attached to a portion facing this inner surface, or such that the pressure sensors are directly attached to the trimmer 53.

Additionally, various sensors may be used as the pressure sensors 56, and if the pressure that the developer undergoes may be detected.

Figure 2:
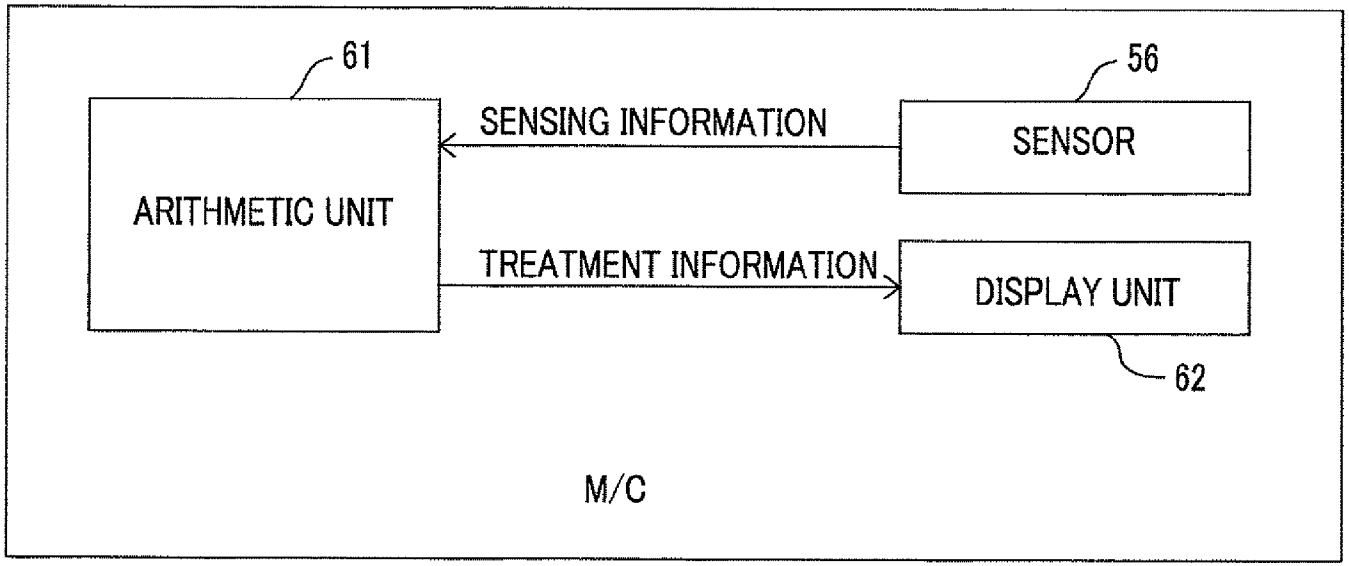
FIG. 2 is a functional block diagram of chief portions of an image forming apparatus related to an exemplary embodiment of the invention.

The pressures detected by the pressure sensors 56 are used for determining the state of developer or determining a treatment concerning toner. In the present exemplary embodiment, as shown in FIG. 2, determination processing is performed by the arithmetic unit 61 of the image forming apparatus, but information on this determination result is displayed and output on a display 62 of the image forming apparatus.

In addition, the information on the determination result may be transmitted and output to an administrator's original management device, for example, via a communication line, and various output units through which a user or an administrator of the image forming apparatus may grasp information may be used.

Figure 3:
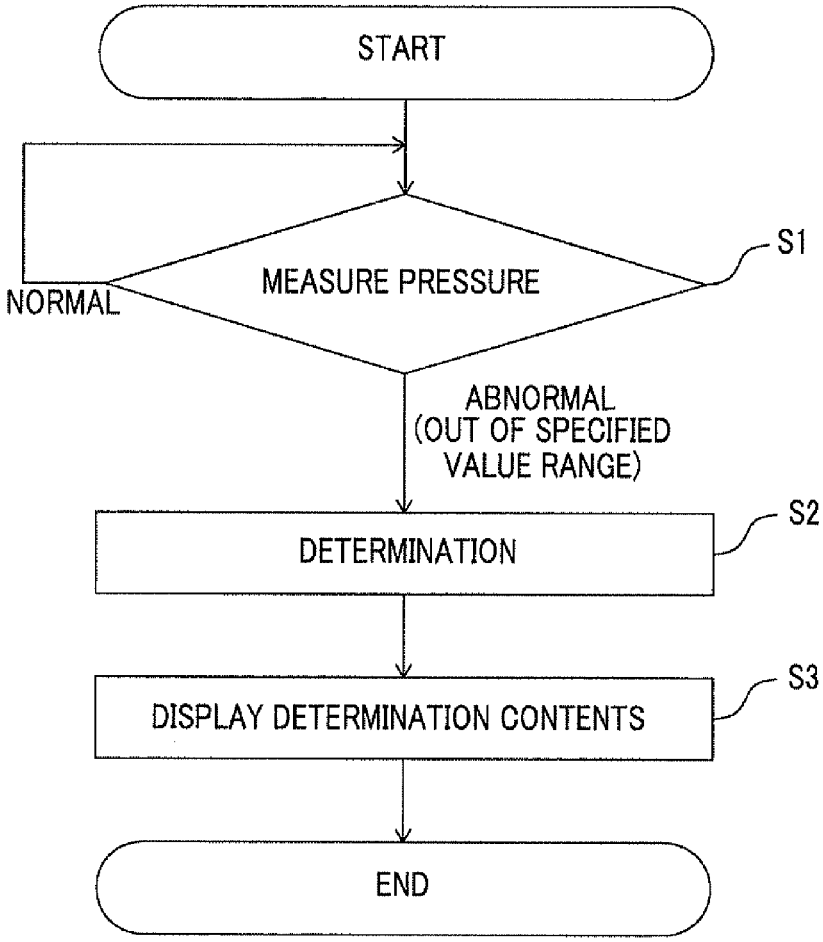
FIG. 3 is a flowchart describing processing related to an exemplary embodiment of the invention.

The image generation apparatus including the above configuration determines and outputs the state of the developer in the developing unit 14, for example, by the processing of the arithmetic unit 61 as shown in FIG. 3.

First, when the developing unit 14 of the above configuration operates in a normal state (in this example, a state where there are no troubles described on the basis of FIGS. 4 to 7), the pressures of the developer G that the respective pressure sensors 56 detect are obtained by experiments or the like, and the detected pressures during this normal operation are set in advance in the arithmetic unit 61 as specified values of the respective pressure sensors 56.

In addition, even when normal operation is not made, since a certain degree of fluctuations may be caused in the detected pressures of the pressure sensors 56 depending on the operation situation or the like of instruments, a specified value range with a certain degree of width is adopted as the specified values in this example.

Since the arithmetic unit 61 is always monitoring the detected pressures of the respective pressure sensors 56 during the operation of the developing unit 14, if any one or more detected pressures within the three pressure sensors 56 are greater than or less than the range of the specified values (step S1), determination of treatment methods concerning the state of developer and toner of the developer, various troubles of the developing unit 14, or the like is performed on the basis of the detected pressures of the three pressure sensors 56 as will be described below 4 to 7 (Step S2).

Then, the arithmetic unit 61 makes the determination contents as will be described below to be output to the display 62 as information on this determination result (Step S3).

The example shown in FIG. 4 shows the determination processing when any one or more detected pressures within the three pressure sensors 56(A, B, and C) are less than the specified value range.

Here, the correspondence relationship as shown in FIG. 4 is set in advance in the arithmetic unit 61, and the arithmetic unit 61 performs determination with reference to this correspondence relationship. In addition, in the example shown in FIG. 4, information on a development defect is also associated. However, the state determination of developer may be made if the correspondence relationship between the detected pressures (output) of the respective pressure sensors 56 and treatments (treatment methods concerning the state of the developer or toner that become determination results) is provided.

As shown in FIG. 4, the arithmetic unit 61 determines "toner replenishment" to the developer G if any one or more detected pressures within the three pressure sensors 56(A, B, and C) are less than the specified value range (pressure Δ that has dropped with respect to normal pressure ○).

It is believed that this is because, if the amount of the toner in the developer decreases (insufficient toner concentration), the non-electrostatic force (frictional force) between particles of the developer decreases, the flowability of the developer G increases, and thereby, detected pressures of any one or more pressure sensors 56 drop.

Additionally, in this example, the arithmetic unit 61 also determines that a development defect, such as "image density decline" and "uneven density of an image", occurs, in a state where the toner has deteriorated as mentioned above.

The information, including the "toner replenishment" and further the "image density decline" or the "uneven density of an image" that are the above determination results, is output from the arithmetic unit 61 to the display 62, and is presented to a user or an administrator.

Thereby, the user or the administrator may suitably grasp a method of making a treatment on the toner with good timing according to the state of the developer. Additionally, in a case where a development defect, such as the "image density decline" or the "uneven density of an image", occurs, it may be grasped that there is a cause in the shortage of the toner of the developer, and the work of cause investigation for other instruments (the photoconductor, the transfer section, and the like) that may be a cause of a development defect may be omitted.

The example shown in FIG. 5 shows the determination processing when any one or more detected pressures within the three pressure sensors 56(A, B, and C) are greater than the specified value range.

Here, the correspondence relationship as shown in FIG. 5 is set in advance in the arithmetic unit 61, and the arithmetic unit 61 performs determination with reference to this correspondence relationship. In addition, in the example shown in FIG. 5, information on a development defect is also associated. However, the state determination of developer may be made if the correspondence relationship between the detected pressures (output) of the respective pressure sensors 56 and treatments (treatment methods concerning the state of the developer or toner that become determination results) is provided.

As shown in FIG. 5, the arithmetic unit 61 determines "forced toner discharge" of the developer G (that is, replacement of toner in the developer) if any one or more detected pressures within the three pressure sensors 56(A, B, and C) are greater than the specified value range (pressure X that has rises with respect to normal pressure ○).

It is believed that this is because, if the toner deteriorates and the amount of charging of the toner in the developer decreases, the flowability of the developer G declines, and thereby, the detected pressures of any one or more pressure sensors 56 rise.

Additionally, in this example, the arithmetic unit 61 also determines that a development defect, such as "graininess degradation" and "uneven density", occurs, in a state where the toner concentration of the developer G is insufficient as mentioned above.

The information, including the "forced toner discharge" and further the "graininess degradation" or the "uneven density" that are the above determination results, is output from the arithmetic unit 61 to the display 62, and is presented to a user or an administrator.

Thereby, the user or the administrator may grasp a method of treating the toner with very appropriate timing according to the state of the developer. Additionally, in a case where a development defect, such as the "graininess degradation" or the "uneven density", occurs, it may be grasped that there is a cause in the toner deterioration of the developer, and the work of cause investigation for other instruments (the photoconductor, the transfer section, and the like) that may be a cause of a development defect may be omitted.

The example shown in FIG. 6 is another application example of determination of the state of developer, and determination is performed using output values of a unit that detects the toner concentration of the developer in addition to the detected pressures of the pressure sensors 56. As a toner concentration detector for the developer, for example, a magnetic permeability detection sensor called a TC (Toner Concentration) sensor may be used to detect the toner concentration (the ratio of the toner to a carrier) of the developer.

Additionally, if the toner concentration detector may detect the toner concentration from the developer G within the developer unit container 51, the installation position of the toner concentration detector, such as a proper position within the developer unit container 51, may be appropriately set.

Here, the correspondence relationship as shown in FIG. 6 is set in advance in the arithmetic unit 61, and the arithmetic unit 61 performs determination with reference to this correspondence relationship. In addition, in the example shown in FIG. 6, information (symptoms) on a development defect is also associated. However, the state determination of developer may be made if the correspondence relationship between the detected pressures (output) of the respective pressure sensors 56 and treatments (treatment methods concerning the state of the developer or toner that become determination results) is provided.

As shown in FIG. 6, although the arithmetic unit 61 basically determines as toner shortage in a case where the detected pressure of any one of the pressure sensors 56 is small, determines as developer deterioration in a case where the detected pressure of any one of the pressure sensors 56 is large, and determines as a sealing defect in a case where the detected pressure of any one of the pressure sensor 56 at both ends is small, the arithmetic unit obtains a determination result by adding the toner concentration detected by the TC sensor to these determination results.

This may further improve the precision of a determination result.

The example shown in FIG. 7 is still another application example of determination of the state of developer, and the future state of developer is determined on the basis of the detected pressures of the plural pressure sensors 56.

In this example, the arithmetic unit 61 stores changes in pressures input from the respective pressure sensors 56(A, B, and C) over time, compares these pressure changes over time with a combination of changes in preset pressures over time as shown in FIG. 7, and determines the future state (that is, a predictor) of the developer.

Figure 7A:
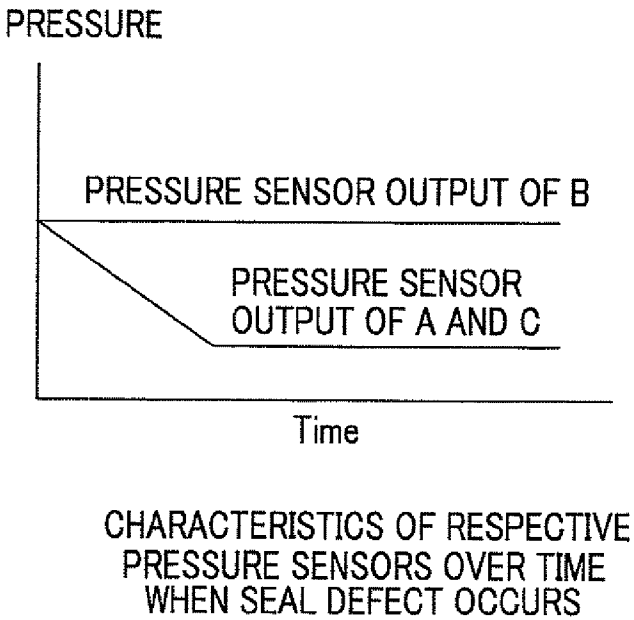
FIGS. 7A and 7B are graphs illustrating prediction processing of the developer state related to an exemplary embodiment of the invention.

For example, as shown in FIG. 7A, in a case where the detected pressure of at least any one of the pressure sensors 56(A, C) provided at both ends shows a characteristic over time that the amount of pressure drop becomes large with time with respect to the detected pressure of the pressure sensor 56(B) provided at the central portion, it is determined that sealing defect will occur in future.

Figure 7B:
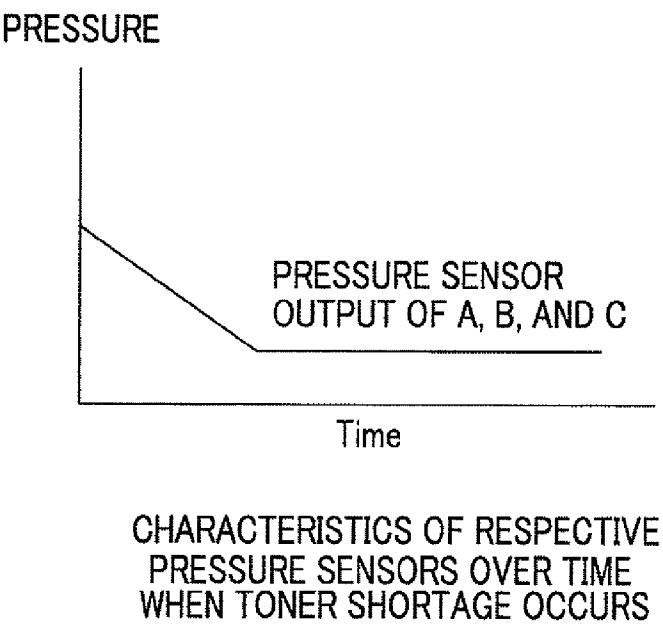

Additionally, for example, as shown in FIG. 7B, in a case where the detected pressures of all the pressure sensors 56(A, B, and C) similarly show a dropping characteristic over time even if a difference does not occur in the characteristics of the detected pressures between the pressure sensors 56 over time as described above, it is determined that toner shortage will occur in future.

Thereby, the user or the administrator may grasp the state of future developer in advance, occurrence of troubles may be prevented in advance, or quick treatments against troubles may be performed.

In addition, whether the above predictor determination is performed at a certain point of time of the characteristics over time shown in FIGS. 7A and 7B (that is, when pressure shows a certain degree of change over time) may be arbitrarily set.

Additionally, although the image forming apparatus that performs development with four colors of toner, such as yellow (Y), magenta (M), cyan (C), and black (K), has been described as an example, the invention is not particularly limited by the kinds or number of toners, the types of image forming apparatuses, or the like if developing devices and image forming apparatuses that perform toner development, are provided, such as an image forming apparatus that performs development with five colors of toner in which a transparent toner is added to the above colors, and an image forming apparatus that performs development with one color of toner of black (K).

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device comprising:

a container that contains developer;

a developing roller that transports the developer from the container in a transport direction toward a photoconductor;

a trimmer having a tip brought close to the developing roller, and provided upstream of the photoconductor in the transporting direction by the developing roller; and a detector provided in a throttling region of an inner surface of the container to detect the pressure caused by the developer, the throttling region being a narrowing region of the container leading to the trimmer that narrows along the transporting direction.

2. An image forming apparatus comprising:

a container that contains developer;

a developing roller that transports the developer from the container in a transport direction toward a photoconductor;

a trimmer having a tip brought close to the developing roller, and provided upstream of the photoconductor in the transporting direction by the developing roller;

a detector provided in a throttling region of an inner surface of the container to detect the pressure caused by the developer, the throttling region being a narrowing region of the container leading to the trimmer that narrows along the transporting direction;

a determination unit comparing the pressure detected by the detector with a preset pressure and determining the state of the developer; and an output unit outputting information of a determination result obtained by the determination unit.

3. The image forming apparatus according to claim 2, wherein the trimmer is long along the width direction of the developing roller, and wherein a plurality of detectors are provided at positions corresponding to at least three places at both ends and a central portion of the trimmer.

4. The image forming apparatus according to claim 3, wherein the determination unit compares a combination of a plurality of pressures detected by the plurality of detectors with a combination of a plurality of preset pressures, and determines the state of the developer.

5. The image forming apparatus according to claim 4, wherein a treatment method concerning toner in the developer is set corresponding to the combination of the plurality of preset pressures, and the determination unit determines the treatment method concerning the toner as the state of the developer.

6. The image forming apparatus according to claim 4, wherein the determination unit stores changes in the plurality of pressures over time as a combination of the plurality of pressures detected by the plurality of detectors, and compares the changes in the plurality of pressures over time with the combination of changes in the plurality of preset pressures over time to predict a future state of the developing device.

* * * * *